US009199835B2

(12) United States Patent
Coan et al.

(10) Patent No.: US 9,199,835 B2
(45) Date of Patent: Dec. 1, 2015

(54) HOUSEHOLD APPLIANCE WITH BEVERAGE DISPENSING SYSTEM, METHOD AND FILTER CARTRIDGE

(75) Inventors: Marco Coan, Stockholm (SE); Daniel L. Johansson, Enebyberg (SE)

(73) Assignee: ELECTROLUX HOME PRODUCTS CORPORATION, Brussels (BE)

( * ) Notice: Subject to any disclaimer, the term of this patent is extended or adjusted under 35 U.S.C. 154(b) by 0 days.

(21) Appl. No.: 14/126,648

(22) PCT Filed: Jun. 21, 2011

(86) PCT No.: PCT/EP2011/060371

§ 371 (c)(1),
(2), (4) Date: Dec. 16, 2013

(87) PCT Pub. No.: WO2012/175118

PCT Pub. Date: Dec. 27, 2012

(65) Prior Publication Data

US 2014/0131382 A1 May 15, 2014

(51) Int. Cl.
*B67D 7/84* (2010.01)
*F25D 23/12* (2006.01)

(52) U.S. Cl.
CPC ..... *B67D 7/84* (2013.01); *F25D 23/126* (2013.01); *F25D 2323/121* (2013.01); *F25D 2323/122* (2013.01)

(58) Field of Classification Search
USPC ..... 222/129, 129.1, 132, 135, 136, 144.5, 222/145.1, 145.5, 478, 488, 481, 146.6, 222/189.06
See application file for complete search history.

(56) References Cited

U.S. PATENT DOCUMENTS

| | | | | |
|---|---|---|---|---|
| 1,887,779 | A * | 11/1932 | Nitesco | 432/91 |
| 7,603,869 | B2 | 10/2009 | Kim et al. | |
| 8,833,100 | B2 * | 9/2014 | Meyerholtz et al. | 62/318 |
| 2002/0020188 | A1 * | 2/2002 | Sharon et al. | 62/371 |
| 2005/0086952 | A1 * | 4/2005 | Nonaka et al. | 62/129 |
| 2007/0163286 | A1 * | 7/2007 | Lim et al. | 62/389 |

FOREIGN PATENT DOCUMENTS

| | | | |
|---|---|---|---|
| DE | 10143070 | A1 * | 5/2002 |
| DE | 102008040603 | | 1/2010 |
| EP | 1614986 | | 1/2006 |

(Continued)

OTHER PUBLICATIONS

International Search Report for PCT/EP2011/060371, dated Jun. 20, 2012, 3 pages.

*Primary Examiner* — Donnell Long
(74) *Attorney, Agent, or Firm* — Pearne & Gordon LLP

(57) ABSTRACT

A household appliance (2) comprising a dispensing system (20) for dispensing a beverage and a compartment (4) which in use of the household appliance (2) is kept cold. A wall portion (22) has a wall thickness extending from the compartment (4) to the ambient environment. A temperature gradient is formed over the wall thickness. The dispensing system (20) comprises an outlet (12) and a first liquid path (26) and a second liquid path (28) for conducting the beverage to the outlet (12). The first liquid path (26) comprises a first conduit section (32) and the second liquid path (28) comprises the second conduit section (34). The first conduit section (32) and the second conduit section (34) are arranged within the at least one wall portion (22) at different positions along the temperature gradient formed in the at least one wall portion (22). Beverage at different temperatures may thus be provided from the dispensing system.

21 Claims, 5 Drawing Sheets

(56) References Cited

FOREIGN PATENT DOCUMENTS

| | | |
|---|---|---|
| EP | 2093529 | 8/2009 |
| KR | 20000002573 | 2/2000 |
| WO | 03033976 | 4/2003 |
| WO | 2009038427 | 3/2009 |
| WO | 2010009776 | 1/2010 |
| WO | 2010055478 | 5/2010 |

* cited by examiner

HOUSEHOLD APPLIANCE WITH BEVERAGE DISPENSING SYSTEM, METHOD AND FILTER CARTRIDGE

TECHNICAL FIELD

The present invention relates to a household appliance comprising a dispensing system for dispensing a beverage according to the precharacterizing portion of claim 1. The invention further relates to a replaceable filter cartridge for a dispensing system of a household appliance and a method for dispensing a temperature controlled beverage from an outlet in a household appliance.

BACKGROUND

In some household appliances, for instance in a refrigerator, a dispensing system for a beverage may be integrated. An outlet for cooled beverage, commonly water, may be provided in a door of a refrigerator. The cooled beverage may be provided at a temperature which is lower than an average water temperature in domestic water pipes. It may be desirable to provide the beverage at a specific temperature.

US2009/0159611 discloses a dispensing system and method for dispensing a temperature controlled fluid in a refrigerator. The system includes a first fluid storage tank for holding the fluid at one temperature, e.g. at 10 degrees Celsius, and a second fluid storage tank for holding the fluid at another temperature, e.g. at 100 degrees Celsius. The first and second fluid storage tanks may be disposed with in a door of the refrigerator. A dispenser outlet is fluidly connected to the first and second fluid storage tanks by at least one fluid line. A proportioning device is disposed along the at least one fluid line between the dispenser outlet and the first and second fluid storage tanks to proportion the fluid delivered from the first and second fluid storage tanks to the dispenser outlet. The proportioning device allows for the selection of a specific temperature for the fluid to be dispensed through the dispenser outlet and delivers the fluid at the selected specific temperature.

U.S. Pat. No. 7,370,491 discloses a fluid storage tank secured to a wall surface of a refrigerator. Incoming water to the fluid storage tank, at about 70 degrees Fahrenheit, is mixed with cold water, at about 37 degrees Fahrenheit, in the fluid storage tank. Thus, water dispensed from the tank may have a temperature of about 50 degrees Fahrenheit.

In connection with a dispensing system for a beverage in a household appliance, there exists a need for a simple and efficient way of providing the beverage at a selectable temperature from an outlet of the dispensing system.

SUMMARY

An object is thus to provide a household appliance with a simple and efficient dispensing system which allows dispensing of a temperature controlled beverage.

According to an aspect, the object is achieved by a household appliance comprising a dispensing system for dispensing a beverage and a compartment which in use of the household appliance is kept cold. The compartment is thermally insulated from an ambient environment by at least one wall portion having a wall thickness extending from the compartment to the ambient environment such that a temperature gradient is formed over the wall thickness. The dispensing system comprises an outlet for dispensing the beverage, and a first liquid path and a second liquid path for conducting the beverage to the outlet. The first liquid path comprises a first conduit section and the second liquid path comprises the second conduit section. The first conduit section and the second conduit section are arranged within the at least one wall portion at different positions along the temperature gradient formed in the at least one wall portion.

Since the first and second conduit sections are arranged at different positions along the temperature gradient, the beverage in the first conduit section will be subjected to a different temperature than the beverage in the second conduit section. The beverage will thus be provided at two different temperatures. Thus, a user may dispense beverage at one of the two temperatures. Further, the beverage from the first conduit section may be mixing with the beverage from the second conduit section to dispense the beverage at a desired temperature between the two temperatures. As a result, the above mentioned object is achieved.

The household appliance may be a refrigerator. The refrigerator may comprise a compartment which is kept cold at a temperature above the freezing point of water, e.g. at 4-8 degrees Celsius. The refrigerator may comprise a compartment which is kept cold at a temperature below the freezing point of water, e.g. at −18 degrees Celsius. Dispensing a temperature controlled beverage encompasses in its simplest form dispensing the beverage at one of two different temperatures, and in a more advanced form dispensing of the beverage at a selectable temperature between the two different temperatures. A temperature may be selected by setting a specific number of degrees, e.g. in Kelvin, Celsius, or Fahrenheit or alternatively, a temperature may be selected intuitively or by experience without setting any specific number of degrees. A wall portion may be formed by one or more walls of the compartment and/or a door of compartment. A purpose of the wall portion is to form part of the enclosure which delimits the compartment from the ambient environment. The wall portion may have a varying thickness. For instance, the wall portion may have a different thickness in an area where the first conduit section and/or the second conduit sections are arranged. The wall may also comprise removable parts or separately attached parts, which parts may protrude into the compartment or protrude in a direction of the ambient environment. The outlet for dispensing the beverage may be arranged in a recess of a door or a wall of the household appliance. Alternatively, the outlet may be provided at an outer side of the door or the wall. The beverage may typically be water but other beverages such as fruit juices or soft drinks may alternatively be dispensed in the dispensing system.

According to embodiments the first conduit section may be arranged closer to the compartment than the second conduit section.

According to embodiments, a first thermal insulation portion may be arranged between the first conduit section and the second conduit section. In this manner it may be ensured that a substantial temperature difference is established between the first and the second conduit section. The temperature gradient will thus progress through the first thermal insulation portion.

According to embodiments, the dispensing system may comprise a valve connected to at least one of the first conduit section or the second conduit section for controlling a flow of the beverage through at least one of the first or the second conduit section. In this manner the temperature of the beverage at the outlet may be controlled may controlling the flow through at least one of the first or second conduit sections. The valve may be connected to the relevant conduit section/s via the corresponding first and/or second liquid path/s.

According to embodiments, the dispensing system may comprise a valve connected to the first conduit section and the second conduit section for controlling a flow of the beverage through each of the first and the second conduit sections. Again, the valve may be connected to the first and second conduit sections via the first and second liquid paths.

According to embodiments, the dispensing system may comprise a first filter. In this manner it may be ensured that the beverage has a high quality. The filter may comprise active carbon which may be suitable for cleaning the beverage when the beverage is water.

According to embodiments, the first filter may comprise the first conduit section. In this manner the first conduit section may be combined with a filter. The beverage may thus be cleaned in the filter while at the same time being subjected to a particular temperature along the temperature gradient in the wall portion. The first filter may be in the form of an exchangeable filter cartridge.

According to embodiments, the first filter may comprise the second conduit section. In this manner the first and second conduit sections may both be provided in on element. The first filter may be in the form of a filter cartridge, the filter cartridge comprising the first and the second conduit sections. This may facilitate exchange of filters in the first and second fluid paths.

According to embodiments, the dispensing system comprises a second filter comprising the second conduit section. The beverage may thus be cleaned in the second filter while at the same time being subjected to a particular temperature along the temperature gradient in the wall portion. The second filter may be in the form of an exchangeable filter cartridge.

According to embodiments, a second thermal insulation portion may be arranged between the compartment and the first conduit section and the second conduit section. In this manner it may be ensured that the first and second conduit sections may be arranged in a specific position along the temperature gradient in the wall portion. This may be an advantage if a temperature inside the compartment is below the freezing point of water.

According to embodiments, the at least one wall portion may comprises a removable lid for accessing the first conduit section and/or the second conduit section. In this manner service or exchange of a relevant conduit section may easily be performed.

According to embodiments, the first conduit section may be arranged at a first flow path distance upstream of the outlet and the second conduit section may be arranged at a second flow path distance upstream of the outlet. The first flow path distance and the second flow path distance have approximately the same length.

According to embodiments, each of the first flow path distance and the second flow path distance is less than 1 meter. In this manner it may be ensured that the temperature of dispensed beverage is affected only by a small degree by the flow path after the first and second conduit sections.

According to embodiments, the first liquid path extends through a cooling arrangement for cooling the beverage upstream of the first conduit section. In this manner cooling capacity affecting the beverage in the first fluid path may be increased. Suitably the first conduit section is closer to the compartment than the second conduit section in these embodiments.

According to a further aspect, an object is to provide a replaceable filter cartridge for a simple and efficient dispensing system of a household appliance, which dispensing system provides for dispensing a temperature controlled beverage.

According to embodiments, the replaceable filter cartridge comprises at least one of the first conduit section and the second conduit section.

According to embodiments, the replaceable filter cartridge may comprise the first conduit section and the second conduit section.

According to embodiments, the replaceable filter cartridge may comprises a first thermal insulation portion arranged between the first conduit section and the second conduit section.

According to a further aspect, an object is to provide a method for dispensing a temperature controlled beverage from an outlet in a household appliance.

Accordingly, there is provided a method for dispensing a temperature controlled beverage from an outlet in a household appliance. The household appliance comprises a compartment which is thermally insulated from an ambient environment by at least one wall portion having a wall thickness. The outlet for the beverage is connected to a first liquid path and a second liquid path. The first liquid path comprises a first conduit section and the second liquid path comprises a second conduit section. The first conduit section and the second conduit section are arranged in the at least one wall portion at different positions along the temperature gradient.

The method comprises:

keeping the compartment cold, whereby a temperature gradient is formed over the wall thickness, directing a first flow of the beverage through the first conduit section, directing a second flow of the beverage through the second conduit section, and dispensing the beverage from the outlet.

Thus the beverage may be dispensed at a temperature between the respective temperatures of the first and second conduit sections.

According to embodiments the method further may comprise:

controlling at least one of the first flow and the second flow. In this manner the temperature of the dispensed beverage may be controlled by the controlling the first flow and/or the second flow.

According to embodiments the method further may comprise:

controlling the first flow and the second flow. In this manner a wider temperature range for the dispensed beverage may be achieved than if only one flow would be controlled.

According to embodiments, the method further may comprise:

cooling the first flow of beverage in a cooling arrangement prior to the said directing the first flow of beverage through the first conduit section. In this manner a larger cooling capacity affecting the beverage in the first liquid path may be achieved than if the first conduit section, due to its position closer to the compartment than the second conduit section, would be the only cooling point for the beverage in the first liquid path.

Further features of and advantages will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein.

Disclosed features of example embodiments may be combined as readily understood by one of ordinary skill in the art to which this invention belongs. Like numbers refer to like elements throughout.

Well-known functions or constructions will not necessarily be described in detail for brevity and/or clarity.

Figure 1:
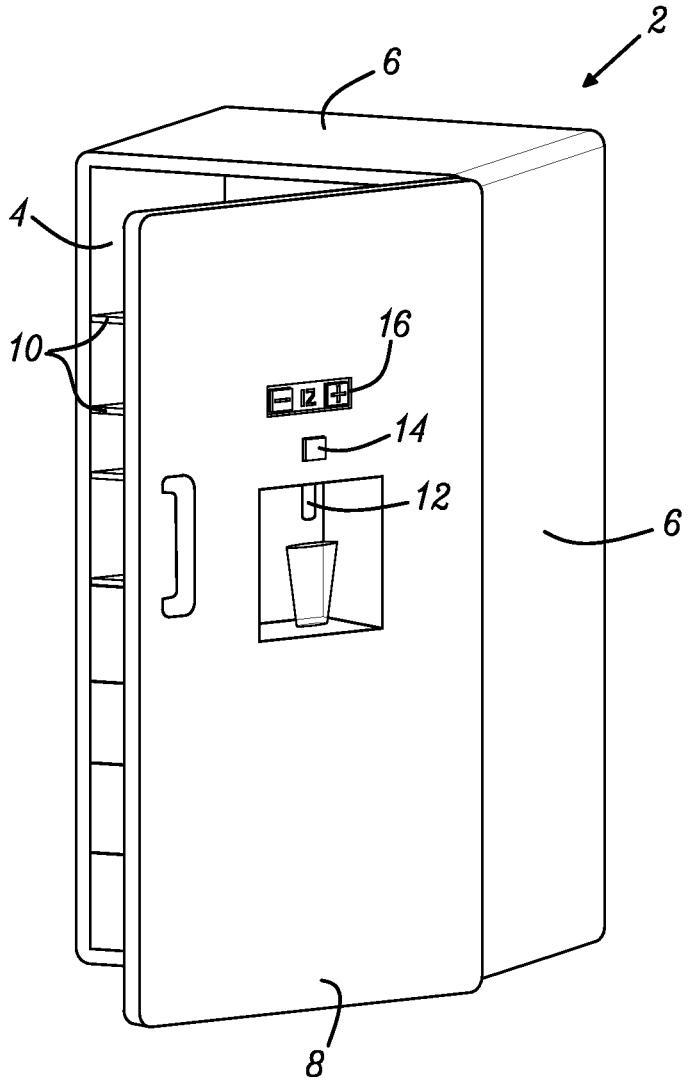
FIG. 1 illustrates a household appliance according to embodiments.

FIG. 1 illustrates a household appliance 2 according to embodiments. The household appliance 2 is illustrated in the form of a refrigerator. The household appliance 2 comprises a compartment 4 for cold storing of e.g. groceries. Accordingly, in use, the compartment 4 is kept cold, for instance by a refrigerant which evaporates in an evaporator of a cooling system. A commonly known cooling system comprises in addition to the evaporator, a condenser, a compressor and a pressure reduction valve. The household appliance 2 comprises walls 6 and a door 8, which thermally insulate the compartment 4 from the ambient environment, in which the household appliance 2 is arranged. Shelves 10 for placing groceries on may be arranged in the compartment 4.

The household appliance 2 comprises a dispensing system for beverage. The dispensing system comprises an outlet 12 for the beverage. The outlet 12 is arranged in a recess of the door 8. The outlet 12 may alternatively be arranged at an outside of the door 8 or in any other manner in relation to the household appliance 2, which allows a user to tap beverage from the outlet 12. The dispensing system comprises a push-button 14 for initiating dispensing of the beverage from the outlet 12. Other arrangements for initiating dispensing of the beverage may alternatively be provided. The dispensing system further comprises a user interface 16 connected to a control mechanism for manipulating a beverage temperature. The user interface 16 may comprise a display for displaying a temperature of the beverage being dispensed and/or a desired temperature set by the user.

The dispensing system comprises a first liquid path and a second liquid path. Both liquid paths lead to the outlet 12. A first flow of the beverage arriving via the first liquid path to the outlet 12 has a different temperature than a second flow of the beverage arriving via the second liquid path to the outlet 12. For instance the first flow of beverage may have a lower temperature than the second flow of beverage. The control mechanism influences at least one of the first and the second flows of beverage to control the temperature of the beverage at the outlet 12. The control mechanism may be set by a user via the user interface 16.

Figure 2:
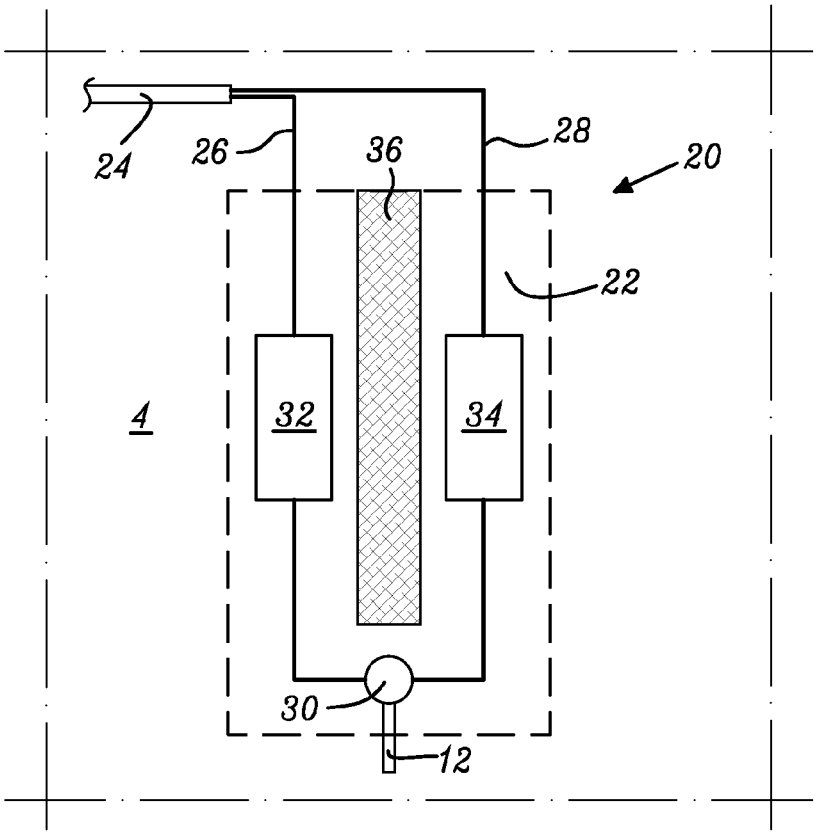
FIGS. 2 and 3 illustrates dispensing systems for a beverage according to embodiments.

FIG. 2 illustrates a dispensing system 20 for a beverage according to embodiments. A wall portion 22 of a household appliance comprises at least part of the dispensing system 20. The wall portion 22 may form part of a door 8 or a wall 6 as illustrated in FIG. 1. The wall portion 22 has a wall thickness which extends from a compartment 4 of the household appliance to an ambient environment of the household appliance. The wall portion 22 thermally insulates the compartment 4 from the ambient environment. Thus, when the compartment 4 is kept cold, a temperature gradient is formed over the wall thickness.

The dispensing system 20 is connected to water main via a hook up pipe 24. Accordingly, the beverage dispensed from the dispensing system 20 is water in these embodiments. A first liquid path 26 and a second liquid path 28 are connected to the hook up pipe 24. The first and second liquid paths 26, 28 lead to an outlet 12 for the beverage, i.e. water, of the dispensing system 20. The first and second liquid paths 26, 28 are connected to the outlet 12 via a control mechanism comprising a valve 30. The valve 30 may be controlled such that the flow of water from each of the first and second fluid paths is controlled between 0% and 100%. Thus, the valve 30 may control the dispensing of water from the outlet 12.

The first liquid path 26 comprises a first conduit section 32 and the second liquid path 28 comprises a second conduit section 34. The first conduit section 32 and the second conduit section 34 are arranged within the wall portion 22 at different positions along the temperature gradient formed in the wall portion 22. In these example embodiments the first conduit section 32 is arranged closer to the compartment 4 than the second conduit section 34. Accordingly, the latter is arranged closer to the ambient environment in the wall portion 22 than the first conduit section 32. A thermal insulation portion 36, such as mineral wool, is arranged between the first conduit section 32 and the second conduit section 34. The first and second conduit sections 32, 34 may each comprise a filter, for instance a filter comprising active carbon. The first conduit section 32 is arranged at a first flow path distance upstream of the outlet 12 and the second conduit section 34 is arranged at a second flow path distance upstream of the outlet 12. The first flow path distance and second flow path distance have approximately the same length.

Due to the temperature gradient, the first conduit section 32 will be positioned in a colder environment than the second conduit section 34. If, for instance, a temperature in the compartment 4 is 4 degrees Celsius, the temperature in the wall portion 22 at the first conduit section 32 may be e.g. 5 degrees Celsius. Correspondingly, if a temperature of the ambient environment is 20 degrees Celsius, the temperature in the wall portion 22 at the second conduit section 34 may be e.g. 19 degrees Celsius. Accordingly, water dispensed from the outlet 12 may have a temperature between 5 and 19 degrees Celsius. The valve 30 is arranged to mix a flow of water from the first flow path 26 with a flow of water from the second flow path 28, and accordingly to mix a flow of water from the first and second conduit sections 32, 34, to dispense water at a temperature desired by a user.

A user may set the valve 30 to dispense water at a desired temperature. The valve 30 may be of a type which a user manipulates directly by hand. The user may operate such a valve using his experience for which setting provides a desired water temperature. The user may also sense the water temperature and adjust the valve. Alternatively, a user interface connected to the valve 30 may provide visual feedback to a user of a current valve/temperature setting. A temperature sensor may be connected to the user interface. The valve 30 may be manipulated by an electric motor. A controller, such as a PID controller, may be connected to the electric motor, the user interface, and the temperature sensor for continuously, or intermittently controlling the valve 30 to dispense water at a desired temperature.

Figure 3:
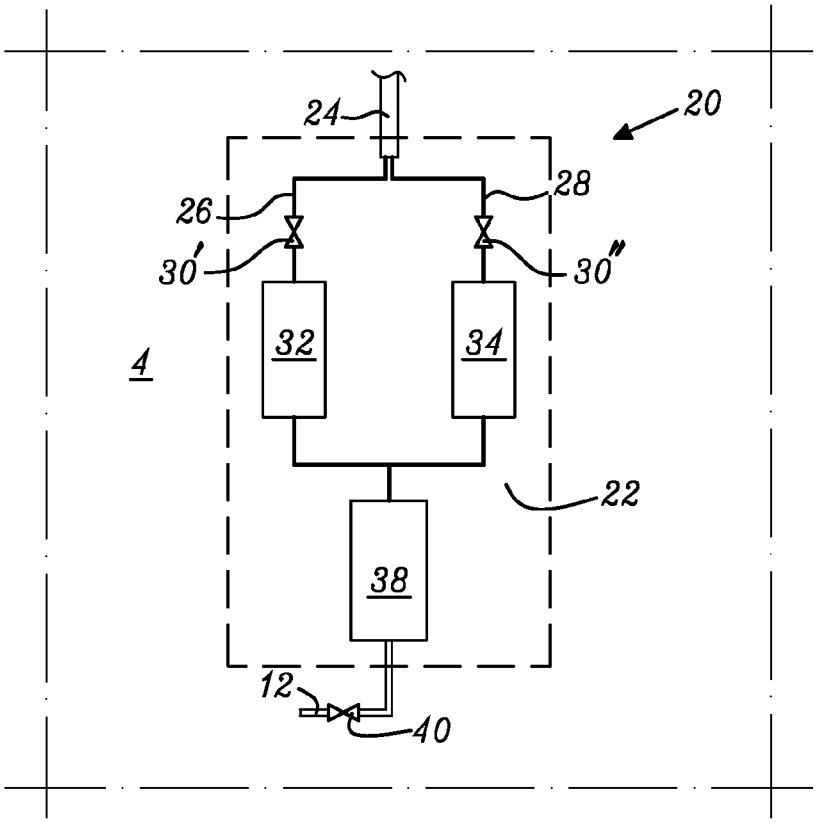

FIG. 3 illustrates a dispensing system 20 for a beverage according to embodiments. The dispensing system 20 of FIG. 3 resembles the dispensing system of FIG. 2. Therefore, the FIG. 3 embodiments are not described at the same detailed level as the embodiments of FIG. 2. The differences between the FIG. 2 and FIG. 3 embodiments will be discussed. Again a wall portion 22 of a household appliance comprises part of the dispensing system 20. The wall portion 22 thermally insulates a compartment 4 of the household appliance from the ambient environment. When the compartment 4 is cooled, a temperature gradient is formed is formed over a wall thickness of the wall portion 22.

A hook up pipe 24 is connected to a water main and leads to a first liquid path 26 and a second liquid path 28. The first and second liquid paths 26, 28 lead to an outlet 12 of the dispensing system 20. The first liquid path 26 comprises a first conduit section 32 and the second liquid path 28 comprises a second conduit section 34. The first conduit section 32 and the second conduit section 34 are arranged within the wall portion 22 at different positions along the temperature gradient formed in the wall portion 22. A thermal insulation portion may be arranged between the first conduit section 32 and the second conduit section 34. The first and second conduit sections 32, 34 may each form a tank for holding a certain volume of water. Such a tank may comprise a tube having a larger cross section than other piping of the first and second liquid paths. A separate filter 38, for instance a filter comprising active carbon, is provided in a conduit leading to the outlet 12.

A control mechanism for controlling the flow of water through each liquid path 26, 28 comprises a first valve 30' arranged in the first liquid path 26 and a second valve 30" arranged in the second liquid path 28. The first and second valves 30', 30" are connected to a controller and a user interface (which are not shown). Again, a temperature sensor may be provided. The valves 30', 30" may be set in various positions to control the flow of water through the first and second liquid paths 26, 28. Thus, water at a temperature desired by a user may be dispensed from the outlet 12. Via the user interface, a user may set the valves 30', 30" to dispense water at a desired temperature. A further valve 40 may be provided close to the outlet 12 for controlling the flow of water through the outlet 12. Alternatively, the first and second valves 30', 30" may control such flow.

An alternative arrangement of valves may comprise only one valve in the first or second flow paths. Suitably, only the second valve 30" may be provided in the second flow path 28. In such an arrangement a further valve 40 for controlling the flow of water through the outlet 12 must be provided. In this arrangement, when a user dispenses water from the dispensing system 20, the further valve 40 opens and a flow of water from the first conduit section 32 flows to the outlet 12. The temperature of the water dispensed from the outlet 12 is controlled by means of the second valve 30" opening to such an extent that a specific flow of water from the second conduit section 34 is established to achieve the desired water temperature. The available temperature range is more limited with this arrangement. Still, the water temperature may be varied within a useful range.

Figure 4:
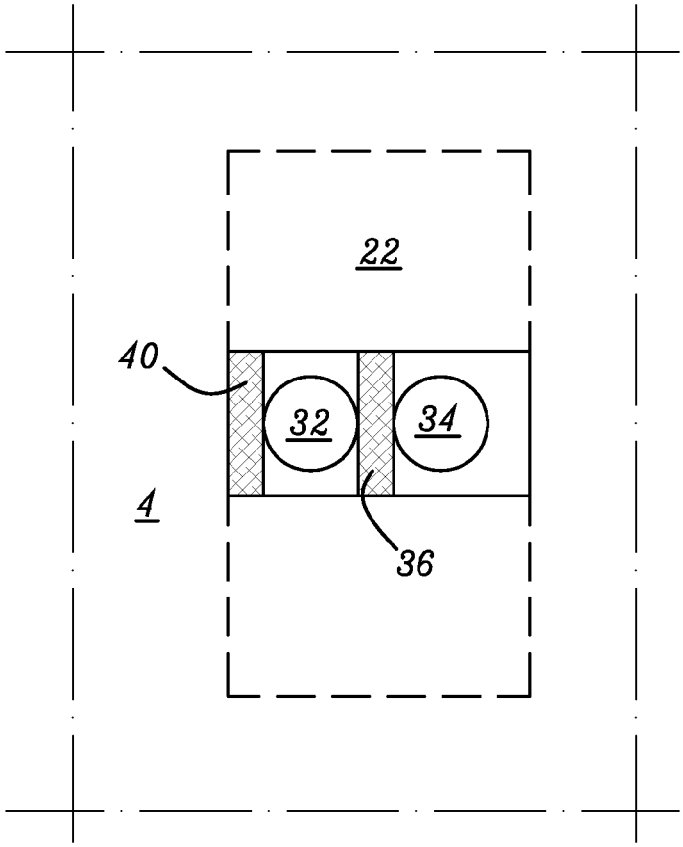
FIG. 4 illustrates a cross section through a wall portion of a household appliance comprising a dispensing system for beverage.

FIG. 4 illustrates a cross section through wall portion 22 of a household appliance comprising a dispensing system for beverage. The household appliance is a refrigerator in which a temperature below the freezing point of water is maintained, also called a freezer. The low temperature is maintained in a compartment 4. The wall portion 22 thermally insulates the compartment 4 from an ambient environment. A temperature gradient is formed over a wall thickness of the wall portion 22. A first conduit section 32 of a first liquid path extends through the wall portion 22 closer to the compartment 4 than a second conduit section 34 of a second liquid path. Accordingly, the first conduit section 32 is subjected to a lower temperature than the second conduit section 34. The beverage in the first conduit section 32 will thus have a lower temperature than the beverage in the second conduit section 34. By mixing the beverage from the first and second conduit sections, the beverage may be dispensed from an outlet of the dispensing system at a desired temperature.

A first thermal insulation portion 36, made from e.g. mineral wool, is arranged between the first and second conduit sections 32, 34. A second thermal insulation portion 40, made from e.g. mineral wool, is arranged between the compartment 4 and the first conduit section 32. Since the first conduit section 32 is arranged closer to the compartment, the second thermal insulation portion 40 is also arranged between the compartment 4 and the second conduit section 34. Thanks to the second thermal insulation portion 40, the first conduit section 32 is arranged in a position in the wall portion 22 where the temperature is above the freezing point of water. Thus, freezing of the beverage in the first conduit section 32 may be avoided.

Figure 5:
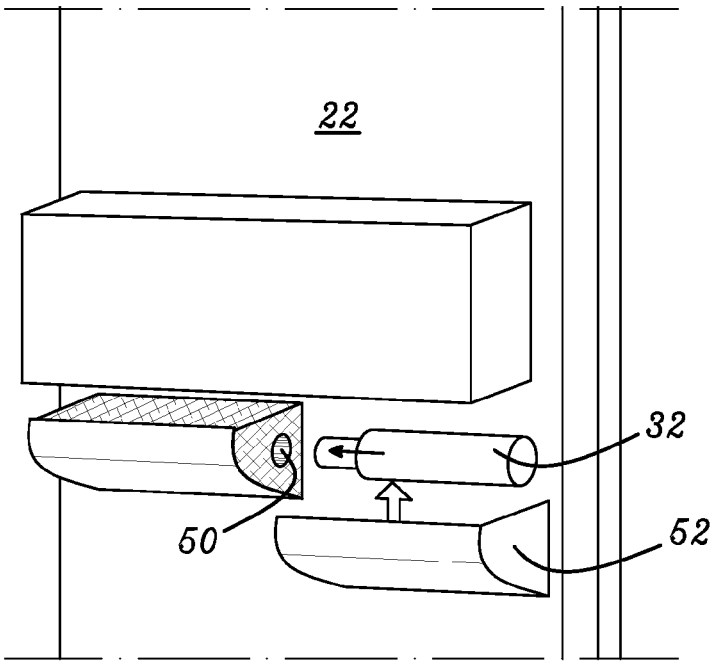
FIG. 5 illustrates a wall portion of a household appliance comprising a dispensing system for beverage according to embodiments.

FIG. 5 illustrates a wall portion 22 of a household appliance comprising a dispensing system for beverage according to embodiments. The wall portion 22 is illustrated in a view from an inside of a compartment of the household appliance. A first conduit section 32 in the form of a filter cartridge is arranged to be connected to the first liquid path via a connecting opening 50 in the wall portion 22. The wall portion 22 comprises a removable lid 52 which is adapted to cover the first conduit section 32. The lid 52 is illustrated in a removed position. In an in-place position the lid 52 covers the first conduit section 32. The compartment is kept cold and a temperature gradient is formed over a wall thickness of the wall portion 22. The wall thickness in the present embodiments includes the width of the lid 52 and extends to an outside of the wall section 22, i.e. the side not visible in FIG. 5. The removable lid 52 provides access to the filter cartridge for service, or exchange, of the filter cartridge.

As in other embodiments, the dispensing system comprises a second liquid path with a second conduit section which is arranged in the wall portion 22 closer to an ambient environment than the first conduit section 32. Accordingly, the beverage which is in the first conduit section 32 will be colder than the beverage in the second conduit section. By mixing the beverage from the first and second conduit sections, the beverage may be dispensed from an outlet of the dispensing system at a desired temperature between the two temperatures of the first and the second conduit sections. The removable lid 52 also may provide access to the second conduit section.

Figure 6:
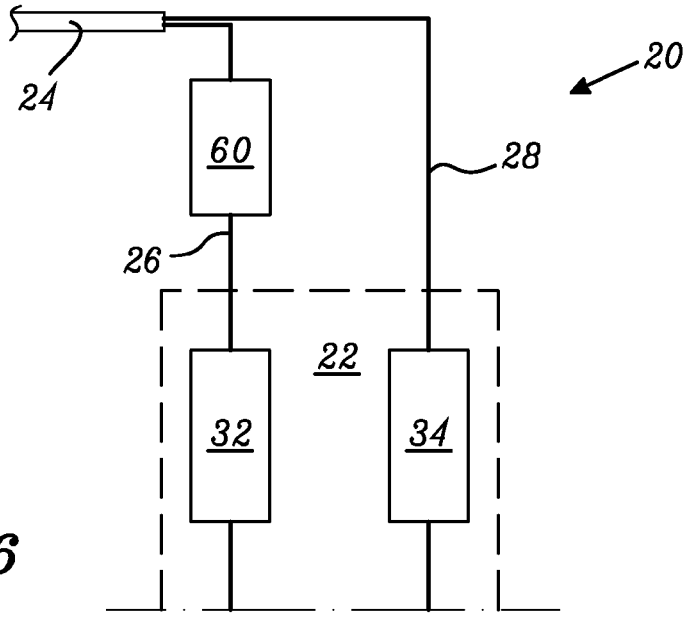
FIG. 6 illustrates a part of a dispensing system for beverage according to embodiments.

FIG. 6 illustrates a part of a dispensing system 20 for beverage according to embodiments. The dispensing system 20 comprises a first liquid path 26 and a second liquid path 28 which are connected to a hook up pipe 24. The first and second liquid paths comprise first and second conduits sections 32, 34 arranged at two different positions along a temperature gradient in a wall portion 22 of a household appliance as described in connection with any of the FIGS. 2-5.

A cooling system for cooling a compartment of the household appliance provides the cooling energy, which cools the beverage in the first conduit section 32. In some situations, e.g. when the flow rate of beverage at a low temperature is such that the beverage is incapable of being sufficiently cooled in the first conduit section. To alleviate this problem, the first liquid path 26 extends through a cooling arrangement 60 for cooling the beverage upstream of the first conduit section 32. The cooling arrangement 60 is adapted to cool the beverage coming from the hook up pipe 24. The cooling arrangement 60 may be dedicated for cooling the beverage and may be designed for efficient cooling of the beverage while it flows through the cooling arrangement 60. Accordingly, the beverage arriving in the first conduit section 32 may be pre-cooled to a certain extent or all the way down to a temperature present in the position along the temperature gradient where the first conduit section 32 is arranged in the wall portion 22.

Figure 7:
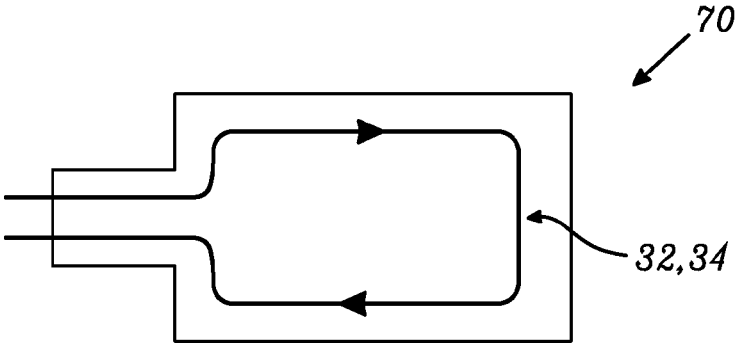
FIGS. 7 and 8 illustrate replaceable filter cartridges for dispensing systems of household appliances according to embodiments.

FIG. 7 illustrates a replaceable filter cartridge 70 for a dispensing system of a household appliance according to embodiments. The filter cartridge 70 comprises a conduit section of a liquid path, i.e. a first or second conduit section 32, 34 of a first or second liquid path 26, 28 as discussed in connection with FIGS. 2-6. The filter cartridge 70 may comprise active carbon.

Figure 8:
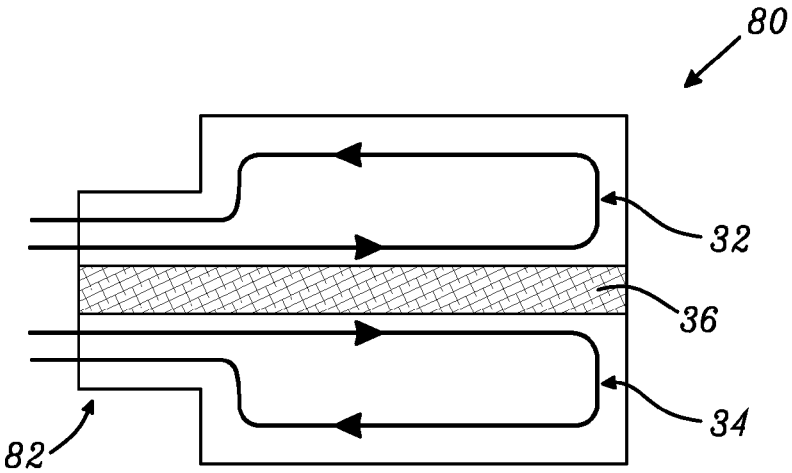

FIG. 8 illustrates a replaceable filter cartridge 80 for a dispensing system of a household appliance according to embodiments. The filter cartridge 80 comprises a first conduit section 32 of a first liquid path and a second conduit section 34 of a second liquid path, i.e. a first and a second conduit section 32, 34 of a first and a second liquid path 26, 28 as discussed in connection with FIGS. 2-6. The filter cartridge 80 may comprise active carbon. The replaceable filter cartridge 80 comprises a thermal insulation portion 36 arranged between the first conduit section 32 and the second conduit section 34. Suitably, the filter cartridge 80 comprises a connector 82 which fits in a socket provided in a wall portion of the household appliance. The connector 82 and the socket ensure that the filter cartridge 80 is positioned correctly in the wall portion.

Figure 9:
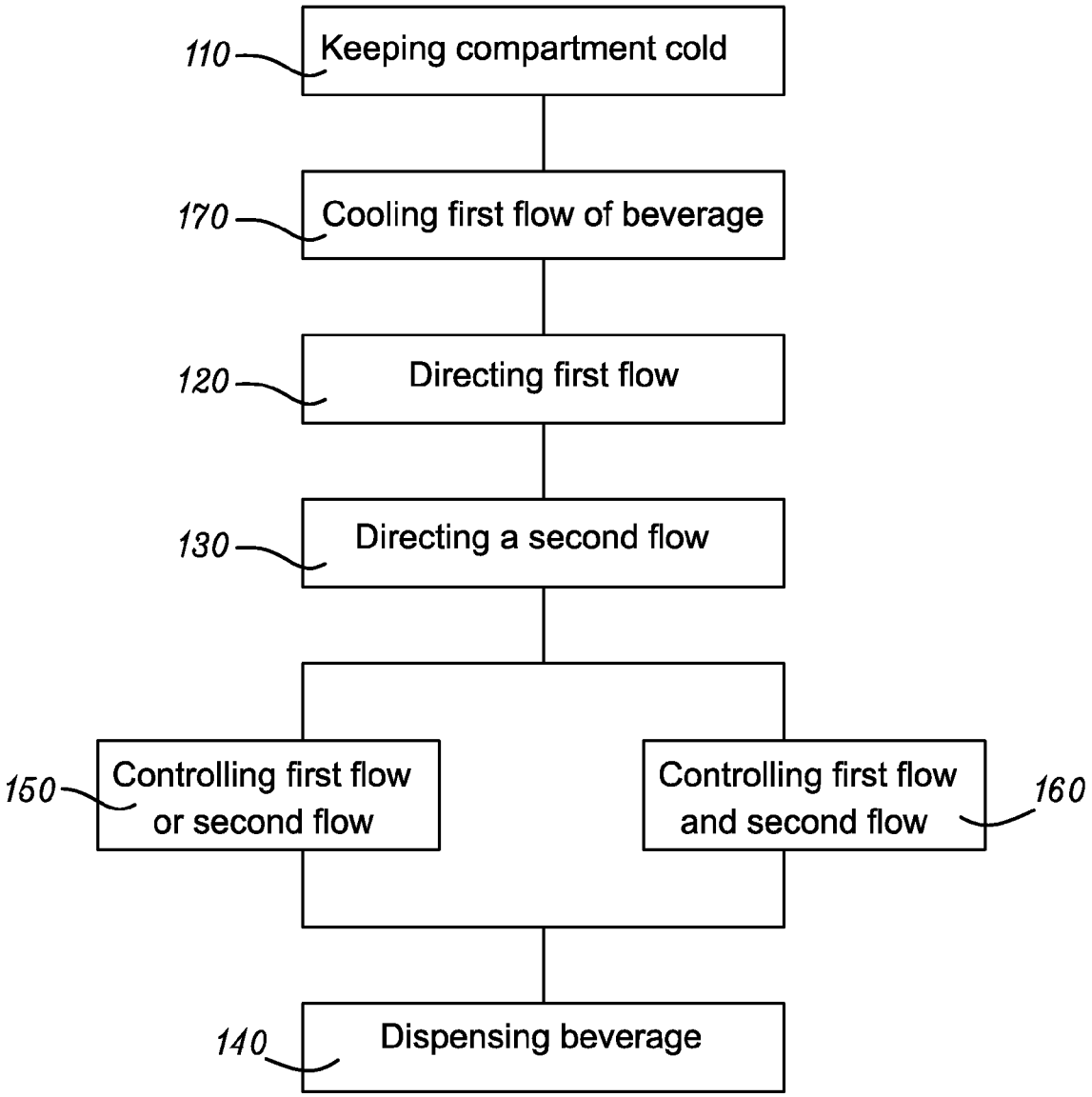
FIG. 9 illustrates embodiments of a method for dispensing a temperature controlled beverage from an outlet in a household appliance.

FIG. 9 illustrates embodiments of a method 100 for dispensing a temperature controlled beverage from an outlet in a household appliance, e.g. as illustrated in connection with FIGS. 1-6. The household appliance comprises a compartment which is thermally insulated from an ambient environment by at least one wall portion having a wall thickness. The outlet for the beverage is connected to a first liquid path and a second liquid path. The first liquid path comprises a first conduit section and the second liquid path comprises a second conduit section. The first conduit section and the second conduit section are arranged in the at least one wall portion at different positions along the temperature gradient.

The method comprises:

Keeping the compartment cold 110, whereby a temperature gradient is formed over the wall thickness, directing a first flow 120 of the beverage through the first conduit section, directing a second flow 130 of the beverage through the second conduit section, and dispensing the beverage 140 from the outlet.

The method further may comprise:

Controlling 150 the first flow or the second flow. This may be achieved by means of a control mechanism comprising a valve 30, 30', 30", as illustrated in FIGS. 2 and 3.

The method alternatively may comprise:

Controlling 160 the first flow and the second flow. This may be achieved by means of a control mechanism comprising a valve 30, 30', 30", as illustrated in FIGS. 2 and 3.

The method further may comprise:

Cooling 170 the first flow of beverage in a cooling arrangement prior to said directing the first flow 120 of beverage through the first conduit section. This may be achieved by means of a cooling arrangement 60, as illustrated in FIG. 6.

The invention has been described with reference to example embodiments, many different alterations, modifications and the like will become apparent for those skilled in the art. For instance may the two valves 30', 30" illustrated in FIG. 3 be used after the first and second conduit sections 32, 34 in the embodiment illustrated in FIG. 2 instead of the valve 30. Conversely, the valve 30 of the FIG. 2 embodiment may be used instead of the two valves 30', 30" before the first and the second conduit sections 32, 34. The first and second conduit sections 32, 34 may be position need not be arranged next to each other or in line in the wall portion 22. The first and second conduit sections 32, 34 may instead be arranged laterally displaced from each other in the wall portion however, still at different positions along the temperature gradient.

Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms "a", an and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "on", "coupled" or "connected" to another element, it can be directly on, coupled or connected to the other element or intervening elements may also be present. In contrast, when an element is referred to as being "directly on", "directly coupled" or "directly connected" to another element, there are no intervening elements present.

It will be understood that although the terms first, second, third etc. may be used herein to describe various elements, components, regions, layers and/or sections, these elements, components, regions, layers and/or sections should not be limited by these terms. These terms are only used top distinguish one element, component, region, layer or section from another element, component, region, layer or section. Thus, a first element, component, region, layer or section discussed herein could be termed a second element, component, region, layer or section without departing from the teachings of the present invention.

Example embodiments of the present invention have been described herein with reference to cross-section illustrations that are schematic illustrations of idealized embodiments (and intermediate structures) of the invention. As such, variations from the shapes of the illustrations as a result, for example, of manufacturing techniques and/or tolerances are to be expected. Thus, embodiments of the present invention should not be construed as limited to the particular shapes of regions illustrated herein but are to include deviations in shape that result, for example, from manufacturing.

The invention claimed is:

1. A household appliance (2) comprising a dispensing system (20) for dispensing a beverage and a compartment (4) which in use of the household appliance (2) is kept cold, the compartment (4) being thermally insulated from an ambient environment by at least one wall portion (22) having a wall thickness extending from the compartment (4) to the ambient environment such that a temperature gradient is formed over the wall thickness, wherein the dispensing system (20) comprises: an outlet (12) for dispensing the beverage, and a first liquid path (26) and a second liquid path (28) for conducting the beverage to the outlet (12), and wherein the first liquid path (26) comprises a first conduit section (32) and the second liquid path (28) comprises the second conduit section (34) characterized in that the first conduit section (32) and the second conduit section (34) are arranged within the at least one wall portion (22) at different positions along the temperature gradient formed in the at least one wall portion (22).

2. The household appliance (2) according to claim 1, wherein the at least one wall portion (22) comprises a removable lid (52) for accessing the first conduit section (32) and/or the second conduit section (34).

3. The household appliance (2) according to claim 1, wherein the first liquid path (26) extends through a cooling arrangement (60) for cooling the beverage upstream of the first conduit section (32).

4. The household appliance (2) according to claim 1, wherein the wall portion (22) has a varying wall thickness.

5. The household appliance (2) according to claim 1, wherein a first thermal insulation portion (36) is arranged between the first conduit section (32) and the second conduit section (34).

6. The household appliance (2) according to claim 5, wherein a second thermal insulation portion (40) is arranged between the compartment (4) and the first conduit section (32) and the second conduit section (34).

7. The household appliance (2) according to claim 1, wherein the dispensing system (20) comprises a valve (30, 30', 30") connected to at least one of the first conduit section (32) or the second conduit section (34) for controlling a flow of the beverage through at least one of the first or the second conduit section (32, 34).

8. The household appliance (2) according to claim 7, wherein the dispensing system (20) comprises a valve (30) connected to the first conduit section (32) and the second conduit section (34) for controlling a flow of the beverage through each of the first and the second conduit sections (32, 34).

9. The household appliance (2) according to claim 1, wherein the dispensing system (20) comprises a first filter.

10. The household appliance (2) according to claim 9, wherein the first filter comprises the second conduit section (34).

11. The household appliance (2) according to claim 9, wherein the first filter comprises the first conduit section (32).

12. The household appliance (2) according to claim 11, wherein the dispensing system (20) comprises a second filter comprising the second conduit section (34).

13. The household appliance (2) according to claim 1, wherein the first conduit section (32) is arranged at a first flow path distance upstream of the outlet (12) and the second conduit section (34) is arranged at a second flow path distance upstream of the outlet (12), and wherein the first flow path distance and the second flow path distance have approximately the same length.

14. The household appliance (2) according to claim 13, wherein each of the first flow path distance and the second flow path distance is less than 1 meter.

15. A replaceable filter cartridge (70, 80) for a dispensing system (20) of a household appliance (2) according to claim 1, wherein the replaceable filter cartridge (70, 80) comprises at least one of the first conduit section (32) and the second conduit section (34).

16. The replaceable filter cartridge (80) according to claim 15, wherein the replaceable filter cartridge (80) comprises the first conduit section (32) and the second conduit section (34).

17. The replaceable filter cartridge (80) according to claim 16 for a dispensing system (20) of a household appliance (2), wherein the replaceable filter cartridge (80) comprises a first thermal insulation portion (36) arranged between the first conduit section (32) and the second conduit section (34).

18. A method (100) for dispensing a temperature controlled beverage from an outlet (12) in a household appliance (2), the household appliance (2) comprising a compartment (4) which is thermally insulated from an ambient environment by at least one wall portion (22) having a wall thickness, wherein the outlet (12) for the beverage is connected to a first liquid path (26) and a second liquid path (28), which method comprises:

keeping the compartment (4) cold (110), whereby a temperature gradient is formed over the wall thickness, characterized in that the first liquid path (26) comprises a first conduit section (32) and the second liquid path (28) comprises a second conduit section (34), the first conduit section (32) and the second conduit section (34) being arranged in the at least one wall portion (22) at different positions along the temperature gradient, and wherein the method further comprises:

directing a first flow (120) of the beverage through the first conduit section (32), directing a second flow (130) of the beverage through the second conduit section (34), and dispensing the beverage (140) from the outlet (12).

19. The method (100) according to claim 18, wherein the method further comprises:

cooling (170) the first flow of beverage in a cooling arrangement (60) prior to said directing the first flow (120) of beverage through the first conduit section (32).

20. The method (100) according to claim 18, wherein the method further comprises: controlling (150) at least one of the first flow and the second flow.

21. The method (100) according to claim 20, wherein the method further comprises: controlling (160) the first flow and the second flow.

* * * * *